US005867994A

United States Patent [19]

Kopko

[11] Patent Number: 5,867,994

[45] Date of Patent: Feb. 9, 1999

[54] DUAL-SERVICE EVAPORATOR SYSTEM FOR REFRIGERATORS

[76] Inventor: William L. Kopko, 5207 Lonsdale Dr., Springfield, Va. 22151

[21] Appl. No.: 933,832

[22] Filed: Sep. 19, 1997

[51] Int. Cl.[6] ..... F25D 17/08

[52] U.S. Cl. ..... 62/82; 62/180; 62/187; 62/282

[58] Field of Search ..... 62/82, 89, 180, 62/186, 187, 282, 407, 408, 409, 417, 419, 441, 443, 446, 447

[56] References Cited

U.S. PATENT DOCUMENTS

| | | | |
|---|---|---|---|
| 3,248,894 | 5/1966 | Harbour | 62/187 X |
| 3,500,655 | 3/1970 | Lyons | 62/186 X |
| 4,122,687 | 10/1978 | McKee | 62/187 X |
| 5,375,428 | 12/1994 | LeClear | 62/282 X |
| 5,732,561 | 3/1998 | Kim . | |

*Primary Examiner*—Harry B. Tanner
*Attorney, Agent, or Firm*—Lorusso & Loud

[57] ABSTRACT

The disclosed refrigeration appliance includes a fresh-food compartment and a freezer compartment with a plenum or duct therebetween housing a single evaporator and at least one fan for establishing air flows through the plenum in opposite directions, an air flow pattern through the plenum and the fresh-food compartment alternating with an air flow pattern through the plenum and the freezer compartment. A condenser, a single compressor and a refrigerant circuit serve to complete the refrigeration system. One-way air valves are located at opposite ends of the plenum, on opposing sides of the fan, and provide communication between the food compartments and the plenum. Two one-way air valves are located at each end of the plenum, one in a wall of the freezer compartment and the other in a wall of the fresh-food compartment. The one-way air valves allow an air flow to be established, selectively, either through the plenum in the fresh-food compartment or through the plenum and the freezer compartment. Operating in a fresh-food compartment cooling mode, air from the fresh-food compartment circulating over the evaporator coils serves to defrost the evaporator coils. Advantages include use of a single evaporator to cool both the freezer compartment and a fresh-food compartment and provision of a defrost cycle without need for a separate heater.

9 Claims, 3 Drawing Sheets

DUAL-SERVICE EVAPORATOR SYSTEM FOR REFRIGERATORS

BACKGROUND OF THE INVENTION

1. Field of the Invention

This invention involves an improved evaporator arrangement for a home refrigerator.

2. Prior Art

FIG. 1 shows a conventional frost-free refrigerator using a single evaporator 10. A fan 12 moves air across the evaporator 10 while the compressor (not shown) is running, which cools the air. Most of the cold air goes into the freezer compartment 14. A small portion of the cold air is used to cool the fresh-food compartment 16. An electric heater 18 is energized with the evaporator fan 12 and compressor off to defrost the evaporator coil. This arrangement is used in virtually all U.S. refrigerators with automatic defrost.

The chief advantage of the arrangement shown in FIG. 1 is simplicity and low cost due to use of only one evaporator and one fan. The single evaporator coil also reduces the space requirement, as compared to two evaporator systems.

The chief disadvantage with the conventional arrangement shown in FIG. 1 is the high energy consumption associated with using a refrigerant at a single evaporating temperature to cool both compartments. The refrigerant temperature needs to be below the freezer temperature, while an efficient system could cool the 5 fresh-food compartment using evaporator temperatures that are 30° to 40° F. higher than those required for the freezer. Since roughly half of the cooling load comes from the fresh-food compartment, the potential energy savings amount to 20% or more for a system that efficiently uses two evaporating temperatures.

There have been several different types of refrigerators that use two evaporators. The "brute-force" solution is to use two completely independent circuits with two compressors. This approach adds a large cost penalty for the additional components. In addition, the theoretical energy savings can be negated by the lower efficiency associated with using two smaller compressors instead of one larger compressor, because compressor efficiency generally worsens at small capacities.

The Lorenz cycle is another approach that uses two evaporators. It uses two evaporators connected in series at essentially the same evaporating pressure. Two evaporating temperatures are achieved using a zeotropic blend of two or more refrigerants as the working fluid combined with internal heat exchangers. The evaporating temperature of a blend increases as the more volatile component evaporates and the liquid becomes richer in the less-volatile component. An internal heat exchanger is used so that two evaporating temperatures are created. Testing has shown that this arrangement gives energy savings approaching 20% with hydrocarbons or HCFCs (hydrochlorofluorocarbons). A major problem has been inability to find a suitable nonflammable, chlorine-free refrigerant blend. Getting the proper refrigerant charge for each component in a blend is also a problem which requires solution.

Other refrigerators use a solenoid valve to switch between two evaporators. A typical arrangement continuously cools the freezer evaporator and uses the solenoid valve to allow refrigerant into the second evaporator only when required to cool the fresh-food compartment. This arrangement is common in Asian refrigerators, and is used to achieve independent temperature control for each compartment. It usually does not provide significant energy savings since the refrigerant temperature is still below the freezer temperature when cooling the fresh-food compartment.

The tandem refrigeration system as disclosed in U.S. Pat. No. 5,406,805 is a recent improvement to the two-evaporator configuration. This prior art system uses two forced-convection evaporators, one for each compartment and each having its own dedicated fan. The control only runs one evaporator fan at a time. When the compressor first comes on, only the fresh-food evaporator fan runs. Once the fresh-food compartment is cooled, the controls turn the fresh-food fan off and then turn on the freezer fan. Defrost is achieved by running only the fresh-food fan and activating an optional solenoid valve to allow free circulation of refrigerant between the two evaporators. A thermosyphon effect allows heat from the fresh-food compartment to defrost the freezer evaporator without the need of an electric heater. This defrost method requires that the fresh-food evaporator be physically lower than the freezer evaporator to allow natural convection to work. Tests have demonstrated energy savings of 10 to 20 percent compared to conventional single-evaporator systems. While the tandem system is a major improvement compared to conventional single-evaporator systems, it still requires two evaporators and two evaporator fans.

SUMMARY OF THE INVENTION

Accordingly, it is an object of the present invention to provide a refrigerator which runs more efficiently than the conventional refrigerators which are currently available. Another object of the present invention is to provide the benefits afforded by the prior art tandem refrigeration system, but with only one evaporator and one evaporator fan in order to lower the cost of the system and improve its efficiency.

In order to fulfill the foregoing objectives, the present invention provides a refrigerator appliance having a fresh-food compartment and a separate freezer compartment. First and second walls separate the freezer compartment from the fresh-food compartment and define therebetween a plenum which houses reversible fan means for alternately circulating a flow of cold air through the fresh-food compartment and then through the freezer compartment. The first wall separates the plenum from the freezer compartment while the second wall serves to separate the plenum from the fresh-food compartment. The refrigeration appliance further includes a single compressor, a condenser and a single evaporator located in the plenum. The refrigerant circuit is in the form of a plurality of tubes which are interconnected to provide a flow of refrigerant through, in succession, the compressor, the evaporator, the condenser and back to the compressor. Reversible fan means is located within the plenum for producing air flow circulation through the freezer compartment in a first direction and, alternately, for producing a flow of cooling air through the fresh-food compartment in a second direction, opposite first direction. At least a first pair of air valves are located in the first and second walls on opposite sides of the reversible fan means, one of which opens responsive to the air flow in the first direction and closes responsive to the air flow produced by the fan in the second direction. The other of the first pair of air valves opens responsive to air flow in the second direction and closes responsive to air flow in the first direction.

In a preferred embodiment, the refrigerator appliance further includes a second pair of air valves located at opposite ends of the plenum with the reversible fan means in between. In this preferred embodiment both of the air valves in the first wall open responsive to air flow in the first direction and close responsive to air flow in the second direction. Likewise, both air valves in the second wall would open responsive to air flow in the second direction and close responsive to air flow in the first direction.

In the preferred embodiment the reversible fan means consists of a single fan which is driven for alternating clockwise and counterclockwise rotation by a reversible motor.

In a preferred embodiment the air valves in the first and second walls are one-way flap valves.

Accordingly, the present invention provides the following advantages:

1. A single evaporator provides efficient, independent cooling for both freezer and fresh-food compartments;

2. A simple combination of a reversible fan and control flap provides for directing cooling to either the fresh-food compartment or the freezer compartment;

3. Warm liquid refrigerant, rather than a separate heat source, is used to warm the contacts of the flap valves to prevent the flap valves from freezing closed; and 4. Air from the fresh-food compartment is used to defrost the same evaporator coil that serves the freezer compartment.

DESCRIPTION OF THE PREFERRED EMBODIMENTS

Figure 1:
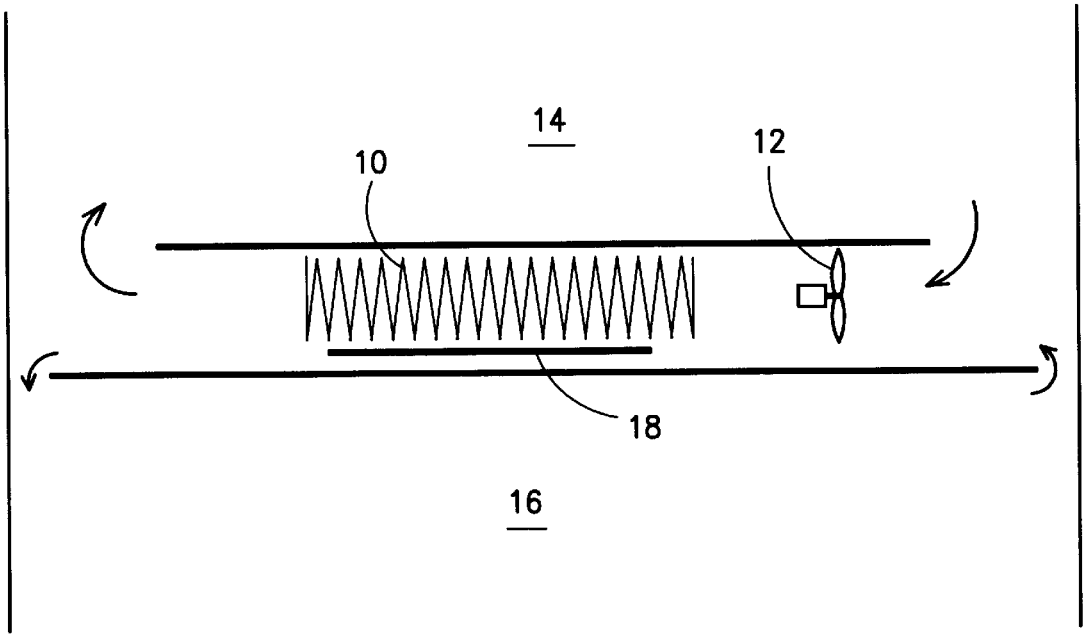
FIG. 1 PRIOR ART
FIG. 1 is a schematic view of a prior art refrigerator having a freezer compartment and a fresh-food compartment.
Figure 2:
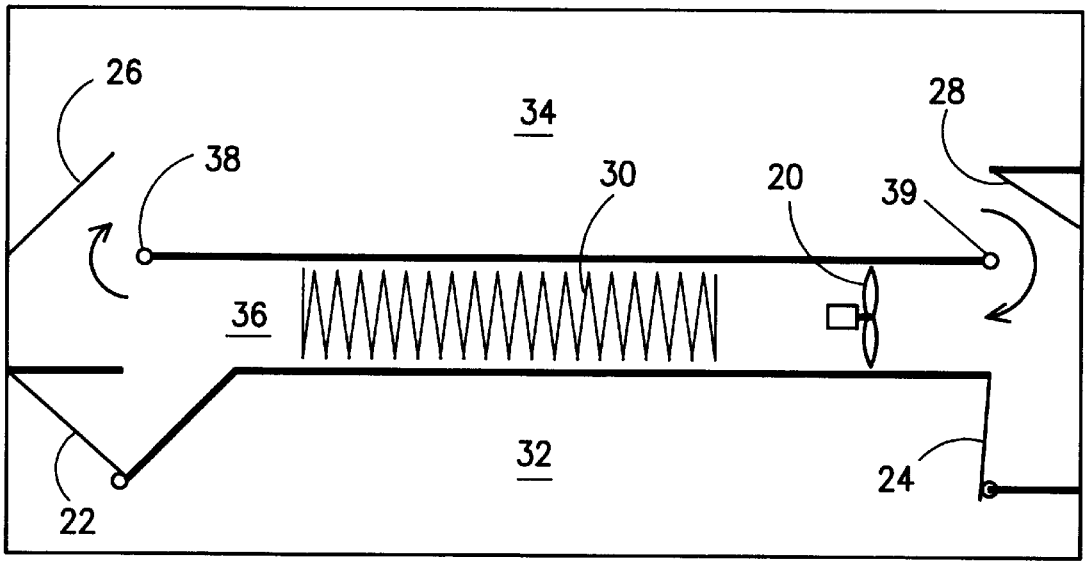
FIG. 2 is a schematic illustration of a preferred embodiment of the present invention operating in a freezer compartment cooling mode.
Figure 3:
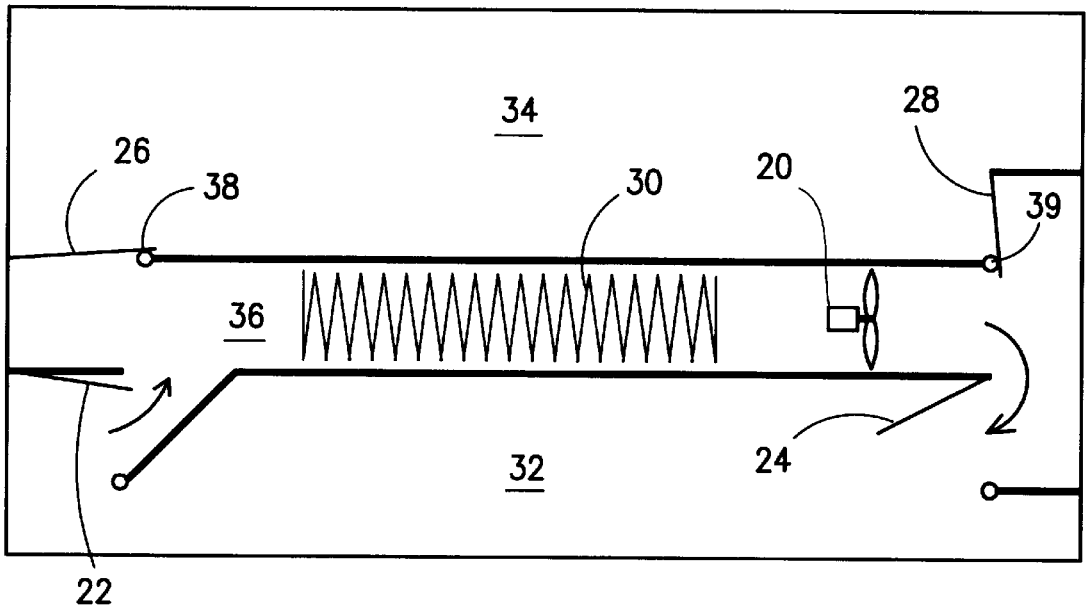
FIG. 3 is a schematic illustration of the preferred embodiment of FIG. 2 operating in FIG. 1 but operating in a combined defrost mode and in, simultaneously, a fresh-food compartment cooling mode and a defrost mode for the freezer compartment.

FIGS. 2 and 3 illustrate a preferred embodiment of the present invention which employs a reversible fan 20 and four flaps or air valves 22, 24, 26 and 28 which are controlled to allow a single evaporator 30 to alternately cool a fresh-food compartment 32 and a freezer compartment 34. Flap valves 22–28 serve as one-way or check valves in that they allow air flow in a single direction only. Accordingly, when the fan 20 blows to the left in the drawings, air valves 26 and 28 of the freezer compartment are opened by the air flow to allow for the circulation of cold air through the freezer compartment, i.e. air cooled by passage over evaporative coil 30. With the air flow to the left in the drawing, i.e. the freezer cooling mode, the flaps of air valves 22 and 24 are forced closed. When the fan 20 is reversed to establish an air flow through the plenum 36 to the left in the drawing, each of the air valves reverses to establish the fresh-food compartment cooling mode in combination with a freezer compartment defrost mode as shown in FIG. 3. Thus, in FIG. 3, an air flow is established by the fan 20 through the plenum 28 and through the fresh-food compartment 32. In this mode, the flaps of air valves 22 and 24 are forced open by the air flow whereas the flaps of air valves 26 and 28 are closed. In the configuration of FIG. 3, air from the fresh-food compartment moves over the evaporator coil to melt any ice accumulation thereon, thus defrosting the evaporator coil. The melting ice also provides useful cooling for the fresh-food compartment 32. Thus, the energy requirement for defrost is nearly zero, representing a savings of 5 to 10 of total energy as compared with a conventional refrigerator.

The flaps of air valves 22, 24, 26 and 28 should be of a very light weight material since air pressure from the fan must be able to push these flaps open, yet rigid enough to prevent back flow. One material suitable for use in fabricating such flaps is a rigid thin sheet of polystyrene foam with a smooth skin on both surfaces. To cope with the potential of ice forming on the surface of the flaps of the air valves, the contacts for the flaps in their closed position may be conduits, as exemplified by 38 and 39 in FIGS. 2 and 3, which receive warm refrigerant liquid from the refrigerant circuit (see FIG. 4). The use of liquid refrigerant to heat the flap surfaces saves energies in two ways, as compared with the more conventional use of electric heaters for similar purposes in refrigerators. First the liquid refrigerant requires no additional electric energy to provide the heat. Secondly, the cooler liquid gives an additional cooling effect in the evaporator that exactly offsets the heating provided. This second advantage means that no additional compressor energy is required to remove the heat beyond that which the liquid refrigerant provides. These effects combined involve no energy penalty for heating, i.e. the energy penalty for heating using the refrigerant liquid is essentially zero.

While the embodiment of FIGS. 2 and 3 is shown as having four air valves, two of such air valves could be eliminated if the resulting air leakage between the freezer compartment and the fresh-food compartment is acceptable. The logical configuration for operation with two such air valves would have one freezer air valve and one fresh-food air valve located at opposite ends of the duct or plenum 38. Two such air valves are the minimum necessary for providing adequate control.

The reversible fan 20 in FIGS. 2 and 3 is suitably a propeller fan with a motor that can reverse its direction of rotation. In an alternative embodiment, two fans would be used in series and arranged to blow in opposite directions with only one fan in operation at any time. This alternative embodiment has the advantage of avoiding the need for a reversible fan but suffers from the disadvantage of the requirement for a second fan. One problem with this alternative embodiment is that air must pass through the fan which is not operating, thus restricting air flow and creating additional pressure drop.

Figure 4:
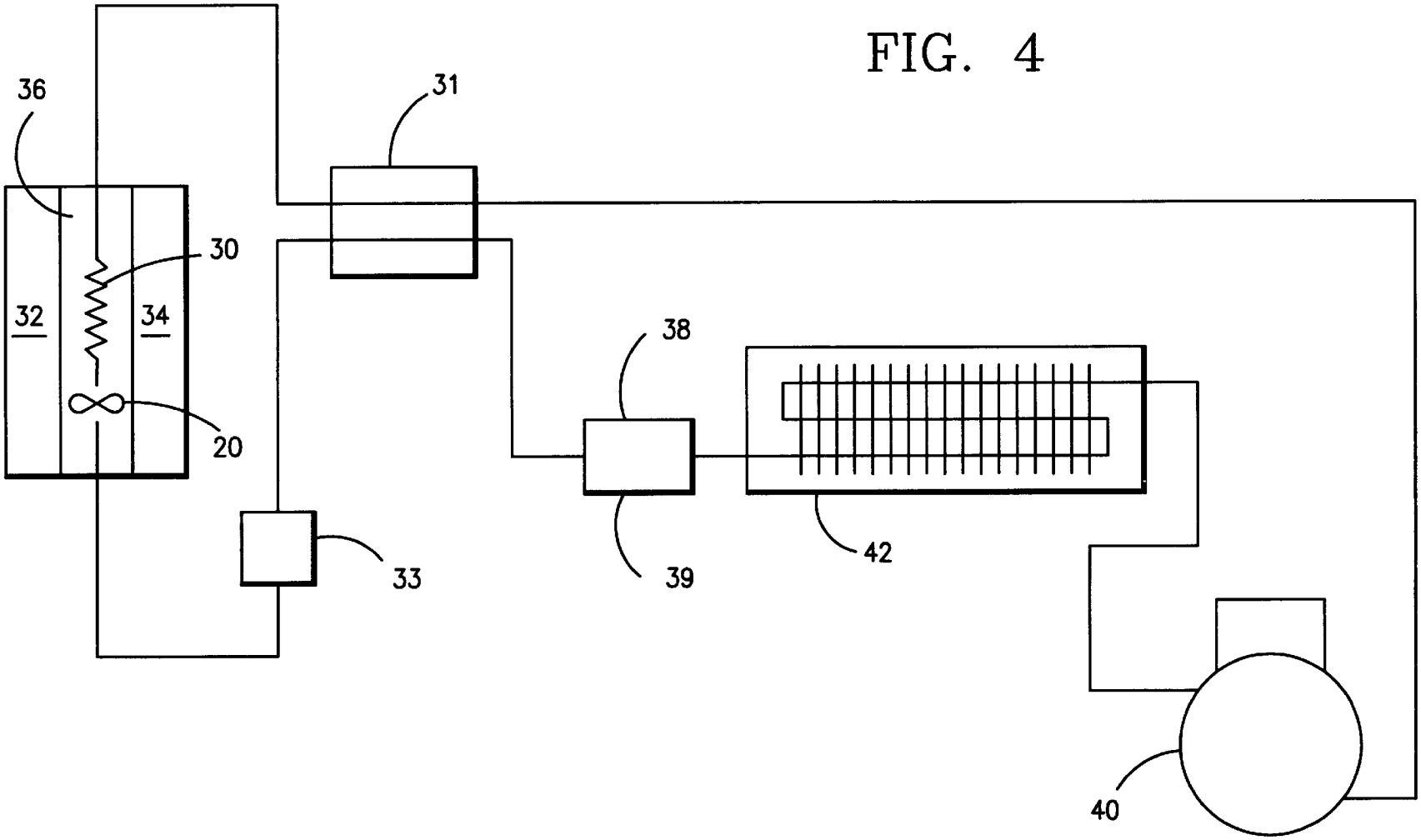
FIG. 4 is a schematic view of a complete refrigeration circuit, inclusive of the evaporator shown in FIGS. 2 and 3.

FIG. 4 shows the overall refrigeration circuit inclusive of the evaporator 30 shown in FIGS. 2 and 3. As shown in FIG. 4, the vaporized refrigerant exiting the evaporator 30 is routed, in succession, through a compressor 40, a condenser 42, the warm refrigerant liquid lines 38, 39, suction-to-liquid heat exchanger 31, cap tube 33 and then back to the evaporator 30. A suction-to-liquid heat exchanger 31 is downstream of the warm lines. A portion of the suction-to-liquid exchanger can also be upstream of the warm liquid lines, as further shown in FIG. 4, so long as the surfaces in the air valves remain sufficiently warm to allow free operation of the air valves. A suction-to-liquid heat exchanger, also called a suction-line heat exchanger, is normally included in domestic refrigerators and uses the warm condenser liquid to warm the suction gas (gaseous refrigerant) going to the compressor to thereby improve cycle performance and reduce undesirable heat gain to the suction gas from the ambient. The different control modes for operation of the refrigeration system depicted in FIG. 4 are shown in the table below.

TABLE

Summary of Control Modes

| | Evaporator Fan | Compressor |
|---|---|---|
| Freezer Cooling | blow left | on |
| Fresh-food cooling | blow right | on |
| Defrost | blow right | off |
| off | off | off |

In operation when the temperature within the fresh-food compartment 32 rises above a predetermined temperature, a signal is provided by a thermosensor or thermostat indicating that cooling is required. Responsive to such a signal, the fan 20 is operated in the fresh-food compartment cooling mode as depicted in FIG. 3. Due to circulation of the air from the fresh-food compartment over the evaporator coil 30 the refrigerant is evaporated and exits evaporator 30 in a gaseous state. After passing through the compressor 40, the refrigerant is at a high pressure and high temperature (approximately 140°–180° F. for refrigerant R12). As the refrigerant passes through the condenser 42 heat is removed by natural convection and/or forced convection if a fan is present. The refrigerant then exits the condenser at approximately the same pressure as is present at the condenser inlet, however with the refrigerant entirely liquid and now at a temperature of approximately 90° F. (or approximately 10° F. above ambient).

Thus, the present invention combines the energy efficiency of dual-evaporator systems with simplicity, low cost and a compactness which approach those of single-evaporator systems. An additional advantage, over the tandem system, is that defrost with the present invention should work equally well with the freezer located below the fresh-food compartment.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed:

1. A refrigeration appliance comprising:

a fresh-food compartment;

a freezer compartment;

first and second walls separating said freezer compartment from said fresh-food compartment and defining a plenum therebetween, said first wall separating said plenum from said freezer compartment and said second wall separating said plenum from said fresh-food compartment;

a single evaporator located in said plenum;

a condenser;

a single compressor;

a refrigerant circuit comprising a plurality of conduits for providing a flow of refrigerant through, in succession, said compressor, said evaporator, said condenser and back to said compressor;

reversible fan means, for producing air flow in a first direction through said plenum and over said evaporator and in a second direction through said plenum and over said evaporator;

a first air valve located in said first wall, at one end of said plenum, said first air valve opening responsive to air flow in said first flow direction to establish a circulating air flow through said freezer compartment and closing responsive to air flow in said second flow direction;

a second air valve located in said second wall at an end of said plenum opposite said one end, with said reversible fan means being located between said first and second air valves, said second air valve opening responsive to air flow in said second flow direction to establish a circulating air flow through said fresh-food compartment and closing responsive to air flow in said first flow direction; and control means for reversing the direction of air flow between said first and second directions.

2. A refrigeration appliance according to claim 1 further comprising:

a third air valve located in said first wall at said opposite end of said plenum with said reversible fan means being located between said first and third air valves, said third air valve opening responsive to air flow in said first flow direction and closing responsive to air flow in said second flow direction; and a fourth air valve located in said second wall at said one end, with said reversible fan means located between said second and fourth air valves, said fourth air valve opening responsive to air flow in said second flow direction and closing responsive to air flow in said first flow direction.

3. A refrigeration appliance according to claim 1 wherein said first and second air valves are one-way flap valves.

4. A refrigeration appliance according to claim 2 wherein said first and second air valves are one-way flap valves.

5. A refrigeration appliance according to claim 1 wherein said reversible fan means consists of a single fan and a reversible motor for reversibly driving said single fan.

6. A refrigeration appliance according to claim 2 wherein said reversible fan means consists of a single fan and a reversible motor for reversibly driving said single fan.

7. A refrigeration appliance according to claim 3 wherein said reversible fan means consists of a single fan and a reversible motor for reversibly driving said single fan.

8. A refrigeration appliance according to claim 4 wherein said reversible fan means consists of a single fan and a reversible motor for reversibly driving said single fan.

9. A refrigeration method comprising:

providing a refrigerator comprising a fresh-food compartment and a freezer compartment, with first and second walls separating the freezer compartment from the fresh-food compartment and defining a plenum therebetween, the first wall separating the plenum from said freezer compartment and said second wall separating said plenum from said fresh-food compartment; a first air valve located in said first wall at one end of said plenum and opening responsive to air flow in a first flow direction; a second air valve located in said second wall at an end of said plenum opposite the one end, with the fan being located between said first and second air valves; a single evaporator located in said plenum; a condenser; and a single compressor;

circulating a flow of refrigerant through, in succession, said compressor, said evaporator, said condenser and back to said compressor;

alternately producing an air flow in a first direction through said plenum and over said evaporator and through the first air valve to circulate the air flow through the freezer compartment and producing an air flow in a second direction through said plenum and over said evaporator, to open the second air valve, to close the first air valve and to thereby circulate the air flow through the fresh-food compartment; and selectively turning off the compressor with air flow in said first flow direction to defrost the freezer compartment.

* * * * *